United States Patent [19]

Rose et al.

[11] Patent Number: 4,997,401

[45] Date of Patent: Mar. 5, 1991

[54] AERIAL TOY

[76] Inventors: Harold J. Rose; Bonnie Maginnis; Nicholas Maginnis, all of 1401 St. James Ct., Apt. 4, Louisville, Ky. 40208

[21] Appl. No.: 442,771

[22] Filed: Nov. 28, 1989

[51] Int. Cl.[5] ..... A63H 27/00

[52] U.S. Cl. ..... 446/64

[58] Field of Search ..... 446/61, 62, 63, 64, 446/65, 66, 67, 68

[56] References Cited

U.S. PATENT DOCUMENTS

| | | | |
|---|---|---|---|
| 2,708,330 | 5/1955 | Ciampolini | 446/67 |
| 2,850,838 | 9/1958 | Henneberry | 446/64 |
| 3,553,884 | 1/1971 | Dunston | 446/64 |
| 3,653,151 | 4/1972 | Laurent | 446/66 |
| 3,909,976 | 10/1975 | Kirk | 446/61 |
| 4,195,439 | 4/1980 | Kramer | 446/68 |
| 4,388,777 | 6/1983 | Hermann et al. | 446/61 |

FOREIGN PATENT DOCUMENTS

| | | | |
|---|---|---|---|
| 368911 | 3/1932 | United Kingdom | 446/67 |

*Primary Examiner*—Robert A. Hafer
*Attorney, Agent, or Firm*—Richard C. Litman

[57] ABSTRACT

An aerial toy of the glider type includes a planar body of generally C-shape provided with a central section bounded by two lateral sections. A single, continuous, substantially curved leading edge having a center nose encompasses the forwardmost portion of the entire body, between wing tips defined by the two lateral sections. The trailing edge of the central section is formed by a horizontal stabilizer and is located substantially forward of the trailing edges of the two lateral sections such that an enlarged relief area is provided rearwardly of the central section and intermediate the lateral sections. A vastly sustained flight time is achieved with this body construction, which presents a center of gravity that passes substantially through a point that is one-third the distance from the craft nose, along the overall longitudinal axis of the body, including the central and lateral sections. Maintenance of this center of gravity, as well as both transverse and longitudinal reinforcement of the body, is provided by the attachment of one or more rigid overlays to the body, juxtaposed the leading edge. Launching of the glider is accomplished through use of an elastic device, releaseably connected to a hook member on the body.

7 Claims, 1 Drawing Sheet

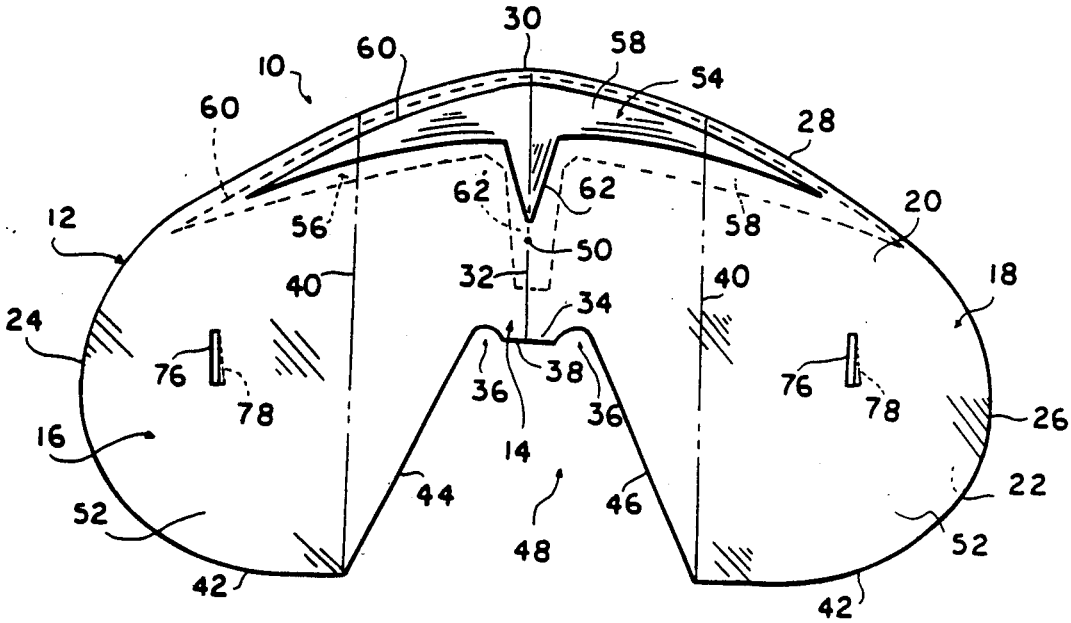
FIG. 1
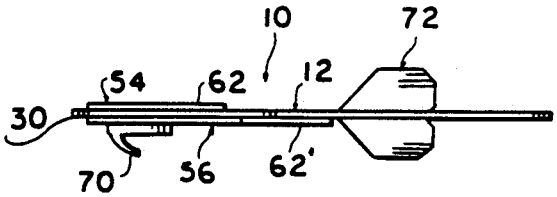
FIG. 2
FIG. 3
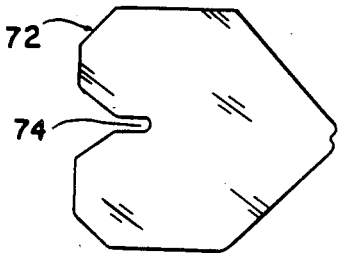
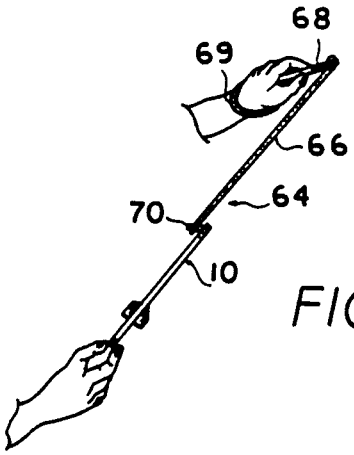
FIG. 4

AERIAL TOY

BACKGROUND OF THE INVENTION

1. Field of the Invention

This invention relates generally, to a toy and more particularly, to an improved aerial apparatus capable of providing superior lift for sustained periods of time and thus allowing flight times of greater duration than prior devices of generally similar construction.

2. Description of the Related Art

Numerous efforts have been expended toward providing aerial toys of various types. In some instances the objective is to achieve realism by simulating actual aircraft and thus the term airplane model. To achieve flight, such models are usually powered by a fuel-driven engine. The construction of these powered models, either by a manufacturer or enthusiast, is quite involved and expensive and the actual flight procedures require at least a certain degree of expertise.

Non-powered flight, on the other hand, presents an opportunity for anyone to become involved in aerial activity, without having any prior experience or expending great sums of money. This may be achieved by means of aerial devices of the glider type. Unlike powered models, toy gliders bear little resemblance to actual aircraft. This is due to two primary reasons. First, the glider must be capable of being produced quickly and simply, by one with little technical expertise and secondly, since weight and drag are of paramount concern, the construction is directed to maximizing lift producing surfaces while eliminating or minimizing all other body components as usually found in powered aircraft, either actual or toy embodiments.

Many examples of prior efforts to provide aerial toys of the glider type are well known. Hardly any youngster has grown up without making and using paper and/or balsa wood gliders. Most such devices comprise a wing, attached to a fuselage terminating in a tail section having one or more control surfaces. In many instances flight characteristics may be altered by unlimited combinations of adjustments of various wing and tail section control surfaces and/or adjustment of the center of gravity by either adding or moving a displaceable weight member or, by longitudinally shifting the position of the wing component. Examples of such gliders as constructed from a folded material will be found in U.S. Pat. Nos. 1,420,805 issued to Baher and 1,522,267 issued to Pierce. The use of a plurality of interfitting components to provide an aerial glider is shown in U.S. Pat. No. 4,642,062.

In the interest of greatly simplifying the construction of toy gliders, a substantially unitary construction has been attempted, wherein the sole or principal component comprises a wing member, often defining a delta or V-shaped configuration. Examples of such aerial devices will be found in U.S. Pat. Nos. 4,388,777 and D-270,259 both issued to Hermann et al.

Aerial toys of the glider type are launched in either of two ways, purely manually, or with the assistance of force multiplying means, such as a sling or elastic member. U.S. Pat. Nos. 2,313,948 and 4,836,817 issued to Lambert and Corbin, respectively, disclose examples of such devices.

None of the prior known aerial toys are seen as providing the unique combination as offered by the instant device wherein vastly improved sustained flight is achieved in a glider comprising a unitary, planar, body member.

SUMMARY OF THE INVENTION

By the present invention, an improved aerial toy is provided which when launched, exhibits a vastly sustained time of flight. Characteristics of the invention which contribute to the exceptional performance of the glider device include its stable construction and unique configuration. The body of the glider comprises a planar member having a substantially symmetrical configuration about a longitudinal center axis, somewhat C-shaped, and preferably formed from lightweight expanded foam composition. The body includes a leading edge defining a smooth curve formed with a large radius and encompassing a central section bounded by two lateral sections, the latter including the two rearmost portions of a trailing edge, which latter edge disposed substantially normal to the longitudinal center axis extends forwardly to the intermediate central section.

Experience has shown that by constructing the glider body so as to insure that the center of gravity is disposed along an axis extending through a point of the longitudinal axis which lies substantially one-third the distance from the nose of the body, the superior performance of the invention is achieved. With this arrangement, transition between a stall and recovery occurs remarkably rapidly and smoothly, resulting in little loss of altitude and an extremely rapid return to smooth flight. The remarkable control over the stability of the angle of attack of the glider is attributable, in part, to the vast expanse of the rigid body, its entire planar undersurface sustaining lift, with the two lateral body sections having a trailing edge disposed substantially rearward of the trailing edge of the central body section.

Adjacent the majority of the body leading edge, there is provided an overlay or protective strip and which may be affixed to both the top and undersurface of the body. In addition to providing mass necessary to maintain the critical center of gravity location, this overlay serves to enhance the useful lifespan of the aerial toy. This latter objective is achieved since upon landing it may strike hard, sharp objects such as buildings, flagpoles etc. and the overlay will be understood to provide reinforcement to the body leading edge. To maintain the critical location of the craft center of gravity, the mass of the added strip is configured in a manner to assure the necessary center of gravity.

As an option, two or more vertical, stabilizing elements may be removably attached to the otherwise planar construction of the glider body. If utilized, such elements in no way improve or degrade the lift capabilities of the toy but rather add directional control. Thus, if aligned parallel with the craft centerline, a more straightforward direction of flight is encouraged and if disposed at a slight angle to one side, the glider will be urged to maintain a slight turn to that side during flight.

To enable appropriate launching of the aerial toy, a hook or the like device is affixed to the undersurface of the glider body for engagement with suitable launching means such as an oversized rubber band or the equivalent. To distribute stresses applied during such launching, the hook device is preferably attached to the reinforcement strip.

Accordingly, one of the objects of the present invention is to provide an improved aerial toy including a unitary, rigid planar body capable of exhibiting substantially lengthy flight.

Another object of the present invention is to provide an improved aerial toy including a planar body defining a generally C-shaped body having a wingspan generally twice as long as the overall length of the body.

Still another object of the present invention is to provide an improved aerial toy including a rigid, planar body having a center section bounded by two lateral sections, with a continuous, curved leading edge joined to a trailing edge having two laterally spaced apart rearmost portions.

A further object of the present invention is to provide an improved aerial toy including a planar body of substantially constant thickness having a central section and two lateral sections with a smoothly convex leading edge encompassing all three sections and joined to a trailing edge having two rearmost portions on the lateral sections which are spaced rearwardly of a central body section trailing edge portion a distance substantially one-half the overall fore-aft length of the body.

With these and other objects in view which will more readily appear as the nature of the invention is better understood, the invention consists in the novel construction, combination and assembly of parts hereinafter more fully described, illustrated and claimed, with reference being made to the attached drawings.

BRIEF DESCRIPTION OF THE DRAWINGS

FIG. 1 is a top plan view of an aerial toy according to the present invention;

FIG. 2 is a right side elevation of the aerial toy of FIG. 1;

FIG. 3 is an enlarged side elevation of a vertical stabilizer member usable with the glider of FIGS. 1-2; and FIG. 4 is a perspective view illustrating a typical manner of launching the invention.

Similar reference characters designate corresponding parts throughout the several figures of the drawings.

DESCRIPTION OF THE PREFERRED EMBODIMENT

Referring now to the drawings, particularly FIGS. 1 and 2, the present invention will be seen to comprise an aerial toy generally designated 10 and which includes a unitary, planar body 12. In plan, the configuration of the body 10 is somewhat kidney or C-shaped and includes a central section 14 bounded by two integral lateral sections 16-18.

The material of the body 12 may comprise any well known substantially stable, lightweight composition such as balsa wood. However, with the advent of today's expanded foam products, such material has been found to be preferred since it has no grain and thus does not split like balsa wood. A thickness on the order of ⅛ inch has been found to be entirely satisfactory. In any case it will be understood that a substantially planar body is produced and which presents parallel, planar top and bottom surfaces 20, 22 respectively.

The entire forward extent of the body, from one wingtip 24 to the other wingtip 26, comprises a leading edge 28 which will be seen from FIG. 1 to be defined by a single, smooth curve having a center point or nose 30. The construction of the central and lateral body sections is quite critical for the successful flight performance of the invention. The central section 14 includes a width which is less than the length or center axis 32 thereof and terminates in a rear stabilizer 34, bounded on either side by a forwardly extending recess or cut-out 36 and which includes a straight, transverse trailing edge 38. Each lateral section 16, 18 includes a longitudinal axis 40 which is substantially longer than the central section axis 32 and terminates in a transversely extending trailing edge 42 which will be seen to communicate on the one end with a respective wing tip 24 or 26 and on the other, with an inner edge 44 or 46. These inner edges of the respective lateral sections 16, 18 are preferably straight and terminate at the central section cut-outs 36, 36. Each of the inner edges 44, 46 forms an included angle, with the adjacent lateral section trailing edge 42, which is preferably less than 45 degrees and the two inner edges provide therebetween, an enlarged cut-out or relief area 48 which encompasses a greater area than that of the body central section 14.

With the above body construction, maintenance of optimum glider flight characteristics is achieved when the center of gravity of the toy 10 passes through a point 50 on the craft centerline 32 which is one-third the distance from the nose 30 to a line joining the two trailing edges 42—42. With the specific gravity of any constant area throughout the body being constant and in view of the sizable mass presented by the enlarged tail areas 52—52 of the two lateral sections 16, 18, the normal center of gravity of the body would lie close to or adjacent, the central section cut-outs 36—36. Any attempt to achieve sustained flight of the body with such a center of gravity would lead to an instant and unrecoverable stall, due to a constant nose high attitude. Accordingly, an ideal pitch is achieved by the inclusion of additional mass, in the form of one or two overlays 54, 56, respectively affixed to the body top and bottom surfaces 20, 22. By applying two such overlays, the expanse and thickness of each is minimized such that, the thickness thereof may be held to less than one-half that of the body material itself. In this manner, negligible boundary layer effect is produced by the addition of the overlays 54, 56.

These overlays are preferably fashioned from lightweight yet relatively stiff material, such as acrylic or other synthetic resins and may be affixed to the glider body 12 by any appropriate adhesive. The overlays may be opaque, translucent or transparent. In the latter instance, any design or coloration applied on the body top and/or bottom surfaces will thus be viewable through the material of the overlay. Each overlay includes a transverse portion 58 having a forward edge 60 which is spaced slightly rearwardly of the body leading edge 28 and extends to substantially overlie at least 60% of the craft wingspan. An overlay center portion 62 projects rearwardly and overlies, at least one-half the length of the central section centerline 32. With two such overlays in place, the center portion 62' of at least one, preferably the bottom one, will be seen to project rearwardly enough to overlie the majority of the centerline 32. These center portions 62, 62' not only contribute toward achievement of the above defined center of gravity, by minimizing the width of the transverse portions of the overlays, but also provide reinforcement of the body in the critical area of the centerline, which area will be seen to be subjected to extra stress during launching of the aerial toy. Accordingly, the two overlays 54, 56 will be seen to provide means not only toward achievement of the required center of gravity but also provide both longitudinal as well as lateral reinforcement or maintenance of the planar state of the body 12. By positioning the forward edges 60 of the overlays slightly rearwardly of the body leading edge 28, the harder substance of the overlays is precluded from making the initial contact when the glider strikes an object. In this manner, the more resilient composition of the body leading edge offers a softer initial contact.

Launching is achieved by means of appropriate force multiplying propulsion means 64 which may comprise an elastic member 66 attached at one end to a handle 68, as shown in FIG. 4. The opposite end of the elastic member 66 is adapted to be engaged to connection means, in the form of a rearwardly facing hook 70 affixed to the overlay 56 on the bottom surface 22 of the body 12. With the foregoing in mind, it will be understood that launch is accomplished by grasping the handle 68 with one hand and pinching the glider central portion 14 between the fingers of the other hand, just ahead of the stabilizer 34, while pulling apart the two hands to stretch the elastic member 66. Thereafter, when the lower grip is released, the glider is projected upwardly to a height of 50–100 feet, or even higher, depending upon the stored energy of the launching means 64. Thereafter, a glider flight of up to five minutes is not uncommon and flights of even greater duration have been experienced. To discourage loss of the handle 68 from the user's grip, a tether or restraining strap 69 attached thereto is slipped about the wrist, as shown in FIG. 4.

Directional stability may be regulated by the inclusion of any number of vertical stabilizers 72 as shown in FIG. 3 and which comprise planar members provided with a longitudinal slot 74 allowing of easy insertion and removal in concert with mating longitudinal slots 76 in the glider body 12. Preferably, the body slots 76 are provided in the medial area of the two lateral sections 16, 18. With the slots 76 parallel to the centerline 32, the direction of flight of the glider will be encouraged toward a straight line. Alternatively, the direction of flight may be encouraged to one side or the other by forming the slots at an angle, such as represented by the slots 78 in FIG. 1. Still another alternative is to construct the vertical stabilizers 72 of a material capable of being deformed, such as cardboard. In this manner, variable directional control may be imparted upon the glider.

It is to be understood that the present invention is not limited to the sole embodiment described above, but encompasses any and all embodiments within the scope of the following claims.

We claim:

1. An aerial toy adapted to be propelled skyward by force multiplying launching means comprising;

a generally flat body having a substantially symmetrical C-shaped configuration about a longitudinal center axis with a wingspan substantially twice its overall length and having substantially planar top and bottom surfaces, said body provided with a central section bounded by two lateral sections and including a continuous leading edge spanning said sections, a continuous trailing edge on said central and two lateral sections, wherein said trailing edge on the two lateral sections include rearmost portions disposed substantially normal to said longitudinal center axis of the body said central section having a longitudinal extent substantially less than that of said lateral sections whereby, said central section trailing edge is disposed substantially forward of said trailing edge on the two lateral sections, and an overlay affixed to both said top and bottom surfaces comprising an elongated traverse portion adjacent said continuous leading edge and a center portion projecting rearward along said longitudinal center axis of the body to provide weight and reinforcement to said body, whereby the center of gravity of said toy is maintained at a point substantially one-third the distance from the forwardmost point of said leading edge to the rearwardmost point of said trailing edge as taken along the line of the longitudinal center axis of said central section.

2. An aerial toy according to claim 1 including, removable vertical stabilizing means attachable to said body.

3. An aerial toy according to claim 1 wherein, said body comprises expanded foam composition.

4. An aerial toy according to claim 1 including, connection means adjacent said body bottom surface and adapted to releaseably engage launching means.

5. An aerial toy according to claim 1 wherein, said lateral sections each include an enlarged tail section disposed laterally and rearwardly of said central section trailing edge.

6. An aerial toy according to claim 1 wherein, said overlay comprises a transparent composition.

7. An aerial toy according to claim 1 wherein, said overlay defines a thickness less than that of said body.

* * * * *